US008729823B2

(12) United States Patent
Swamy et al.

(10) Patent No.: US 8,729,823 B2
(45) Date of Patent: May 20, 2014

(54) REGULATING SYSTEMS

(75) Inventors: Rajendra Swamy, Northville, MI (US); Chris Luman, Sterling Heights, MI (US)

(73) Assignee: OSRAM Opto Semiconductors GmbH (DE)

( * ) Notice: Subject to any disclaimer, the term of this patent is extended or adjusted under 35 U.S.C. 154(b) by 197 days.

(21) Appl. No.: 13/340,113

(22) Filed: Dec. 29, 2011

(65) Prior Publication Data

US 2013/0169163 A1 Jul. 4, 2013

(51) Int. Cl.
*G05F 1/00* (2006.01)
*H05B 37/00* (2006.01)

(52) U.S. Cl.
USPC ..... 315/291; 315/312

(58) Field of Classification Search
USPC ..... 315/291, 224, 312; 345/102, 204, 690, 345/207
See application file for complete search history.

(56) References Cited

U.S. PATENT DOCUMENTS

| | | | | |
|---|---|---|---|---|
| 6,956,337 | B2 * | 10/2005 | Kemper | 315/307 |
| 7,119,503 | B2 * | 10/2006 | Kemper | 315/309 |
| 2002/0171371 | A1 | 11/2002 | Janning | |
| 2002/0171373 | A1 | 11/2002 | Muthu | |
| 2003/0128174 | A1 | 7/2003 | Scheibe | |
| 2005/0162099 | A1 * | 7/2005 | Kemper | 315/291 |
| 2006/0066266 | A1 | 3/2006 | Li Lim et al. | |
| 2006/0097978 | A1 * | 5/2006 | Ng et al. | 345/102 |
| 2007/0045524 | A1 | 3/2007 | Rains, Jr. et al. | |
| 2011/0199753 | A1 * | 8/2011 | Ramer et al. | 362/84 |

FOREIGN PATENT DOCUMENTS

| | | |
|---|---|---|
| EP | 1 898 677 | 3/2008 |
| WO | 2007/071397 | 6/2007 |
| WO | 2008/078274 | 7/2008 |

OTHER PUBLICATIONS

Product Guide "iW Blast TR—Rugged, intelligent white LED spotlight for entertainment environments," Philip Color Kinetics, 2010.
Product Guide "My light can be 'Morning Sun', LED-Downlight E8 1-10V, LED Downlight E8 DMX," LUMITECH Produktion und Entwicklung GmbH, Jun. 2010.
Subramanian Muthu et al.: "Red, Green, and Blue LED based white light generation: Issues and control," IEEE Publications, pp. 327-333, 2002.
TAOS Data Sheet "TCS3404, TCS3414 Digital Color Sensors," Texas Advanced Optoelectronic Solutions Inc.: Apr. 2011: pp. 1-40.

* cited by examiner

*Primary Examiner* — Minh D A
(74) *Attorney, Agent, or Firm* — DLA Piper LLP (US)

(57) ABSTRACT

A regulating system includes a tricolor LED system including at least one first LED that emits light having a first color, at least one second LED that emits light having a second color, and at least one third LED that emits light having a third color, at least one fourth LED that emits light having a fourth color, a sensor that detects the light emitted by the LEDs and generating sensor signals representing characteristics of the light, a controller that outputs control signals depending on the sensor signals and reference values, and LED drivers that drive the first, second, third and fourth LEDs depending on the control signals.

16 Claims, 13 Drawing Sheets

REGULATING SYSTEMS

TECHNICAL FIELD

This disclosure relates to regulating systems for LED lighting systems.

BACKGROUND

Known LED lamps and LED systems can be adjusted to meet a specific color point or color temperature. US 2002/0171373 shows a RGB tricolor LED system which tracks desired tristimulus values.

These systems merely allow for the input of a small range of desired light spectra and to create these spectra. Creating a wide range of desired light spectra could therefore be helpful. The desired light spectrum may be based on an object being lit. Further, there should be only a slight spectral deviation of the emitted spectrum from the desired light spectrum over a period of time.

SUMMARY

We provide a regulating system including a tricolor LED system including at least one first LED that emits light having a first color, at least one second LED that emits light having a second color, and at least one third LED that emits light having a third color, at least one fourth LED that emits light having a fourth color, a sensor that detects light emitted by the LEDs and generating sensor signals representing characteristics of the light, a controller that outputs control signals depending on the sensor signals and reference values, and LED drivers that drive the first, second, third and fourth LEDs depending on the control signals.

DETAILED DESCRIPTION

Figure 1:
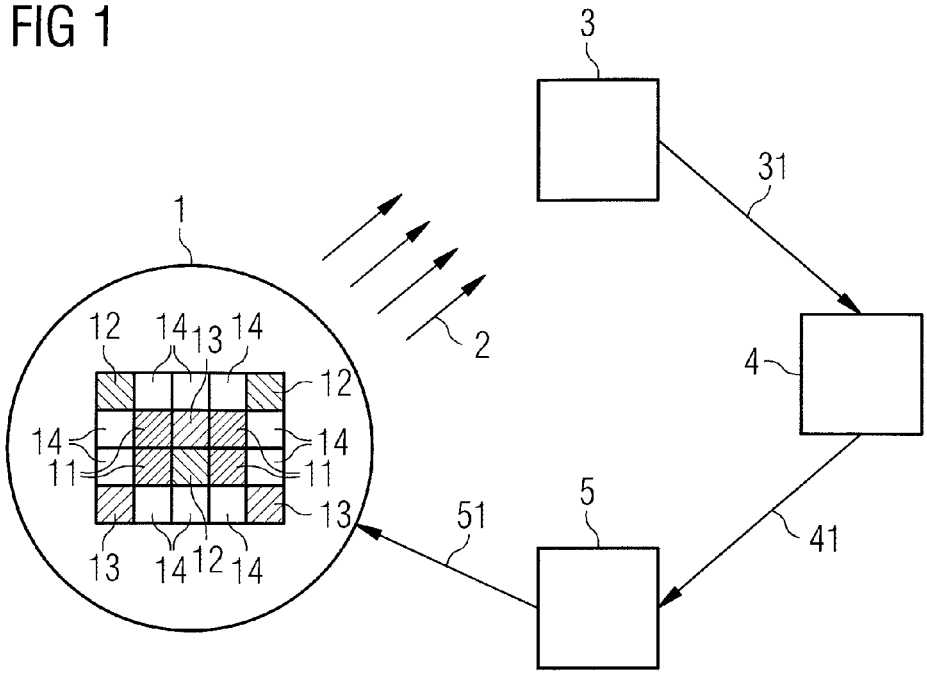
FIG. 1 is a block diagram of an example of a regulating system.

It will be appreciated that the following description is intended to refer to specific examples of structure selected for illustration in the drawings and is not intended to define or limit the disclosure, other than in the appended claims.

We provide a regulating system comprising a tricolor LED system comprising at least one first LED that emits light having a first color, at least one second LED that emits light having a second color, and at least one third LED that emits light having a third color, at least one fourth LED that emits light having a fourth color, a sensor that detects light emitted by the LEDs and generates sensor signals representing characteristics of the light, a controller that outputs control signals dependent on the sensor signals and reference values, and LED drivers that drive the first, second, third and fourth LEDs dependent on the control signals.

The reference values may represent characteristics of a given or desired power spectral density.

This regulating system gives the user the flexibility of matching the emitted light to a desired spectral power density. The regulating system is flexible, which allows the user to input and maintain a desired spectrum to enhance or subdue color contrasts of objects or spaces being illuminated based on reflectance distributions and color characteristics of the objects under light.

The system can be used to target a specific spectrum to highlight objects based on their color characteristics. Also, the system gives the user the flexibility of selecting a desired spectrum based on the objects being illuminated.

The following exemplary applications show how the flexibility to adjust different spectral power densities can be used: In a grocery store, a light source can be tuned to the spectral reflectance of banana, lettuce, cucumber, carrot etc. In the medical field, the optimum light for operating rooms according to the tissue type and the wound field texture can be tuned. The right light for working in harmony with the human circadian rhythm (biological clock) can be chosen.

An advantage of the system is the ability to incorporate several saturated and broadband LED spectra in the system to create a desired spectral power density. The system may comprise saturated colors, e.g., red, green and blue, and a broadband color, e.g., white, to maintain a desired spectral power distribution of light. The system is not limited to just three spectra, like tricolor LED systems, or only saturated or only monochromatic spectra. Any number of monochromatic and broadband LEDs can be used to create the desired spectral power density. The regulating system not only maintains a target white point, but also maintains a desired spectrum that does not have to be white. This is not achieved by a mere tricolor RGB system. An additional, e.g., white or broadband, LED is needed.

By incorporating broadband and saturated LEDs in the system the overall power consumption can be reduced and the lifetime of the system can be improved. The controller can maintain the desired power spectral density within a given tolerance range and compensate ageing effects and thermal runaway of the LEDs.

The regulating system may comprise a sensor that is suitable for measuring the characteristics of mixed light emitted by the tricolor LED system and the fourth LED, which may be basis for adjusting the tricolor LED system, and measuring the characteristics of the light emitted by the fourth LED, which may be basis for adjusting the fourth LED. These measurements may be performed by a single sensor measuring the characteristics of the mixed light during a first time interval and measuring the characteristics of the light emitted by the fourth LED during a second time interval, where the tricolor LED system does not emit light. The sensor may be an RGB sensor suitable for generating triple values representing the RGB characteristics of the light. The same RGB sensor may be used to measure characteristics of the mixed light and the characteristics of the light, e.g., being white, emitted by the fourth LEDs.

The system may incorporate a predetermined target spectrum converted into reference tristimulus values and compares these with the output of the sensor that is constantly measuring the light output of a multitude of LEDs and provides tristimulus values. Errors generated between the values in turn may be fed to a proportional-integral (PI) feedback control loop that controls the LED drivers driving the LEDs until the tristimulus values of the light measured by the sensor match the reference tristimulus values. A PI controller calculates an error value as the difference between a measured process variable and a desired value. The controller may attempt to minimize the error by adjusting the process control inputs. The PI controller calculation may involve a proportional and an integral value, denoted P and I. These values may be interpreted in terms of time: P depends on the present error, I on the accumulation of past errors. The weighted sum of these actions may be used to adjust the process via the controller.

The control signals may be generated depending on tristimulus values. The reference tristimulus values describe characteristics of the target spectrum. Feedback tristimulus values represent characteristics of the light detected by the sensor. The feedback tristimulus values may be provided by a sensor component or generated in a microchip serving also as a controller.

The reference tristimulus values may comprise triple tristimulus values including an X value, a Y value and a Z value. The feedback tristimulus values may comprise a triple of tristimulus values which represent the characteristics of the mixed light or the light emitted by the tricolor system, including an X' value, a Y' value and a Z' value. The control signal for driving the first LED is generated depending on an error between the X value of the reference tristimulus values and the X' value of the feedback tristimulus values. The control signal that drives the second LED is generated depending on an error between the Y value of the reference tristimulus values and the Y' value of the feedback tristimulus values. The control signal that drives the third LED is generated depending on an error between the Z value of the reference tristimulus values and the Z' value of the feedback tristimulus values.

The control signal that drives the fourth LED is generated depending on further values. The reference tristimulus values may comprise a further tristimulus value being one of an X value, a Y value and a Z value of the desired light component emitted by the fourth LEDs. The feedback tristimulus values may comprise a further tristimulus value being one of an X' value, a Y' value and a Z' value, the further tristimulus value representing the characteristic of light emitted by the fourth LEDs. The control signal that drives the fourth LED may be generated depending on an error between at least the further tristimulus values of the reference tristimulus values and the feedback tristimulus values. Preferably the further values are X values both, Y values both or Z values both.

An additional, e.g., PI, control loop may be incorporated into the regulating system to maximize brightness. Such a regulating system further comprises an additional controller that adjusts the reference values depending on the control values generated by the controller and a reference control value. A comparator may be provided to output a maximum value of the control signals. A summing block outputs an error signal between the reference control value and the maximum value, the error signal being applied to the additional controller that may serve as PI controller.

The controller may generate pulse width modulation (PWM) signals to control the LED drivers, thereby driving the LEDs.

Further features, refinements and expediencies become apparent from the following description of selected representative examples in connection with the drawings.

FIG. 1 shows a block diagram of an example of a regulating system suitable for emitting light having given characteristics, e.g., a desired spectral power distribution (SPD).

The regulating system comprises a multitude of LEDs 1 which comprises a tricolor LED system having first LEDs 11, second LEDs 12 and third LEDs 13 that may be saturated LEDs or monochromatic LEDs.

In this instance, the first LEDs 11 emit red light. The second LEDs 12 emit green light. The third LEDs 13 emit blue light. Alternatively, the tricolor LED system may comprise cyan, yellow and deep blue emitting LEDs. Other color combinations are possible.

The multitude of LEDs 1 further comprises broadband spectrum fourth LEDs 14 which may emit white light. Alternatively, the fourth LEDs may emit mint light or another color. The mixed light 2 emitted by the multitude of LEDs 1 comprises spectral components provided by the first, second, third and fourth LEDs 11, 12, 13, 14.

The example shown in FIG. 1 comprises four red LEDs 11, three green LEDs 12, three blue LEDs 13 and ten white LEDs 14.

The regulating system further comprises a sensor 3, a controller 4 and LED drivers 5.

The sensor 3 detects characteristics of the light 2 emitted by the multitude of LEDs 1 and provides sensor signals 31 representing these characteristics of the light 1. The sensor 3 may be a RGB sensor which measures a triple of RGB values.

The sensor signals 31 are applied to the controller 4 which generates control signals 41 depending on the sensor signals 31 and reference values indicating the given spectral power distribution that should be emitted by the multitude of LEDs 1. The controller 4 may be a microcontroller(s) or microchip(s). The control signals 41 may include pulse width modulation (PWM) signals to control the LED drivers 5.

The controller 4 compares characteristics of the light 2 represented by the sensor signals 31 with the reference characteristics and provides control signals 41 so that the light 2 is adjusted such that its characteristics become equal or close to the given reference characteristics.

The characteristics of the reference spectral power density can be predetermined using calculations or experiments the results of which are converted into tristimulus values. The reference values may be stored in the controller 4. Alternatively, the reference values may be applied to the controller 4 by an input device (not shown in FIG. 1). One example of an input device comprises at least one potentiometer which serves as a user interface. Alternatively, a detector is provided to detect a reference light which may be created by several saturated or monochromatic LEDs, and measure its characteristics. However, the regulating system may create the reference spectral power density using multiple saturated or monochromatic LEDs, e.g., red, green, blue, yellow, verde LEDs, and broadband spectrum LEDs.

The control signals 41 are applied to the LED drivers 5 which generate driving signals 51 for the multitude of LEDs 1. Different driving signals 51 are provided for the first, second, third and fourth LEDs 11, 12, 13, 14. The driving signals 51 may be attached to the first, second, third and fourth LEDs 11, 12, 13, 14 via four constant current lines, e.g., a first line for driving the first LEDs 11, a second line for driving the second LEDs 12, a third line for driving the third LEDs 13 and a fourth line for driving the fourth LEDs 14. The emitted light of each type of LEDs 11, 12, 13, 14 is varied depending on the current on the respective line.

The components of the regulating system form feedback loops, wherein information about the light characteristic is fed back to the multitude of LEDs 1 to adjust the emitted mixed light 2.

Figure 2:
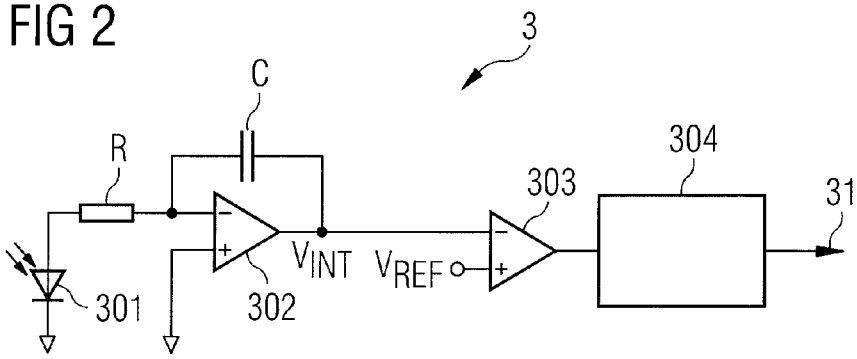
FIG. 2 shows an example of a sensor.

FIG. 2 shows an example of the sensor 3 comprising a series connection of a photodiode 301 and a resistor R. A capacitor C and an amplifier 302 integrate the photocurrent from the filtered photodiode 301 to provide a voltage VINT. A comparator 303 and a counter 304 are coupled downstream of the amplifier 302. At a given level VREF the comparator 303 is tripped and the counter 304 increments. Then the capacitor C discharges and the integration starts again. The total number of counts over a given integration period may be provided as sensor signal 31. The mentioned integration process is analogous to integrating the photons incident on the photodiode 301 and thus the counts are proportional to the incident flux. The time over which counts are accumulated can be varied. The photocurrent amplification can also be changed to adapt to darker conditions.

Figure 3:
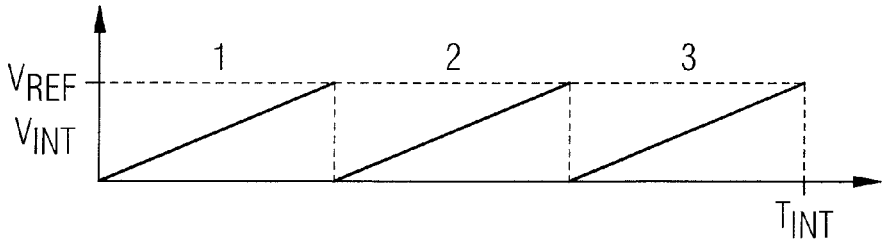
FIG. 3 illustrates a counting process of the sensor.

FIG. 3 illustrates the counting process, the voltage VINT is shown depending on the time.

The sensor 3 comprises at least three photodiodes and counting arrangements as shown in FIG. 2, each to determine one of the RGB characteristics of the light 2.

Figure 4:
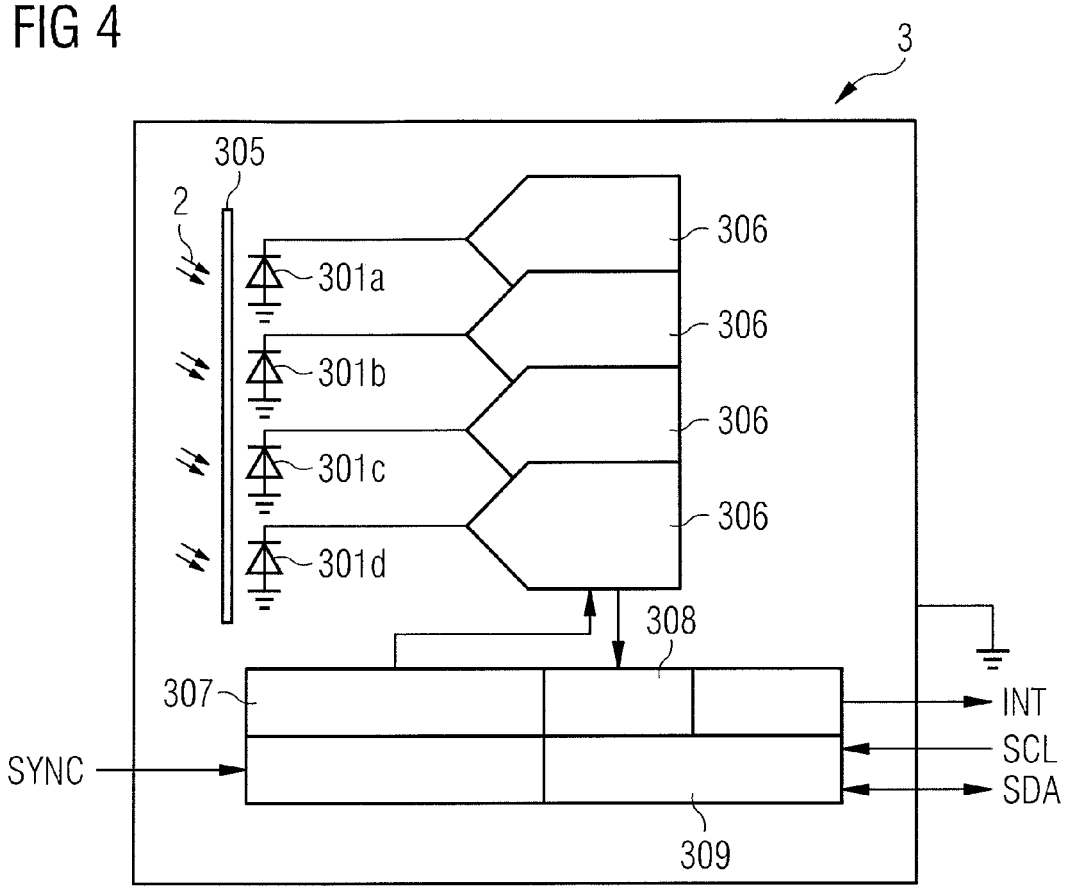
FIG. 4 shows a block diagram of an RGB tricolor sensor.

FIG. 4 shows a block diagram of an RGB tricolor sensor comprising an IR blocking filter 305 between the incoming light 2 and four photodiodes 301*a*, 301*b*, 301*c*, 301*d*. One 301*a* is provided for a red channel. One 301*b* is provided for a green channel. One 301*c* is provided for the blue channel. One 301*d* is provided for a clear channel.

"Red channel" means that the respective photodiode 301*a* has a spectral observer function that is very sensitive to red light. "Green channel" means that the respective photodiode 301*b* has a spectral observer function that is very sensitive to green light. "Blue channel" means that the respective photodiode 301*c* has a spectral observer function that is very sensitive to blue light. The "clear channel" has a broadband photodiode 301*d*. The photodiodes 301*a*, 301*b*, 301*c* are filtered to provide enhanced responses to red, green and blue light. Different filters may be used to correspond to the saturated first, second and third LEDs 11, 12, 13 that are used. An integrating A/D converter 306 is coupled downstream to each photodiode 301*a*, 301*b*, 301*c*, 301*d*.

The sensor 3 further comprises a command register 307 and a 4 parallel ADC register 308 to receive the output of the A/D converters 306. The sensor 3 may be synchronized by a SYNC signal. Further, a clock signal SCL may be applied. Interrupts INT may be generated by the sensor 3. A two wire serial interface 309 enables communication with the sensor 3.

Figure 5:
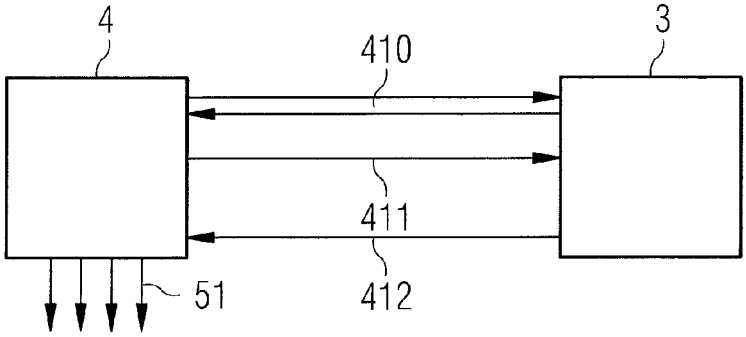
FIG. 5 illustrates an example of a communication between a sensor and a controller.

FIG. 5 illustrates the communication between the sensor 3 and the controller 4 and shows the main information channels in the system. Color data is sent and received over an I2C bus 410. A synchronous pin 411 is used to adjust the integration periods or the time over which counts are accumulated. An interrupt line 412 enables the sensor 3 to signal the controller 4 that the data has been compiled and that it is ready to be retrieved via the I2C bus 410.

The controller 4 generates the control signals, e.g., 10 bit RGBW PWM signals for the LED drivers 5.

Figure 6:
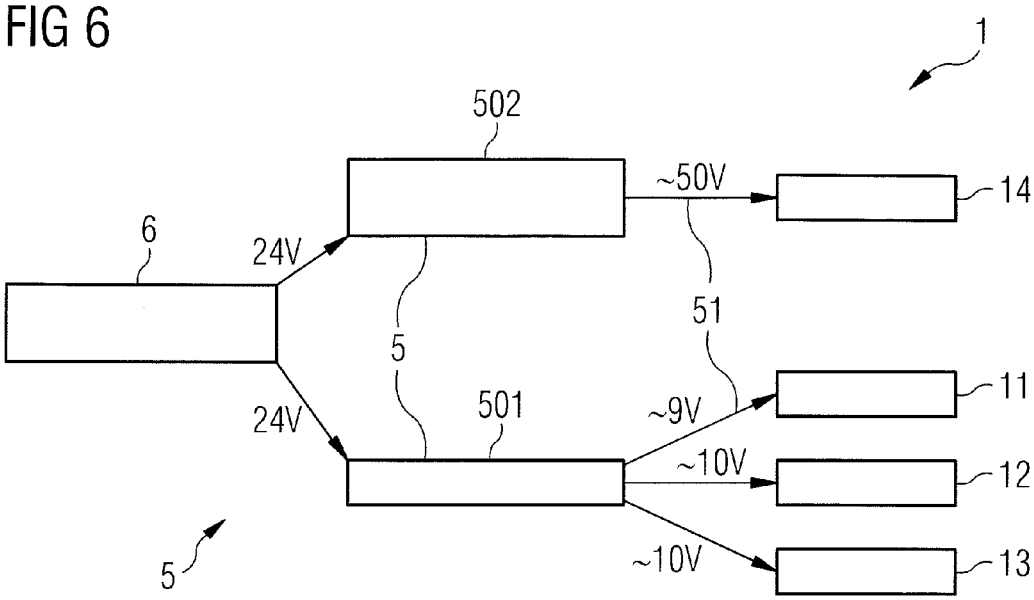
FIG. 6 shows a block diagram of an LED driver.

FIG. 6 shows a block diagram of the LED drivers 5 driving the multitude of LEDs 1. The LED drivers 5 comprise a power supply 6 which provides a 24V input voltage for a boost driver 502 driving the fourth LEDs 14 that may emit white light. The input power is stepped up for the 380 mA white string. The efficiency of the boost driver 501 is about 85%.

The input power of 24V is also applied to a three channel buck driver 501 driving the red, green and blue light emitting first, second and third LEDs 11, 12, 13 of the tricolor LED system. The input voltage is applied to the buck driver 501 which provides about 9V for the first LEDs 11 and about 10V for the second and third LEDs 12, 13. The input voltage is stepped down for the 400 mA red, green and blue strings. Current in the LEDs is higher than normal binning currents due to PWM control signals being less than 100%.

The LED spectrums driven by the LED drivers 5 may vary with respect to the current. Constant current power supplies are used to reduce this variance. At the core there is a voltage source controlled by a current sensing feedback loop. Such a constant current feedback loop controller may be coupled in parallel with a resistor that is coupled in series with a chain of LEDs.

Figure 7:
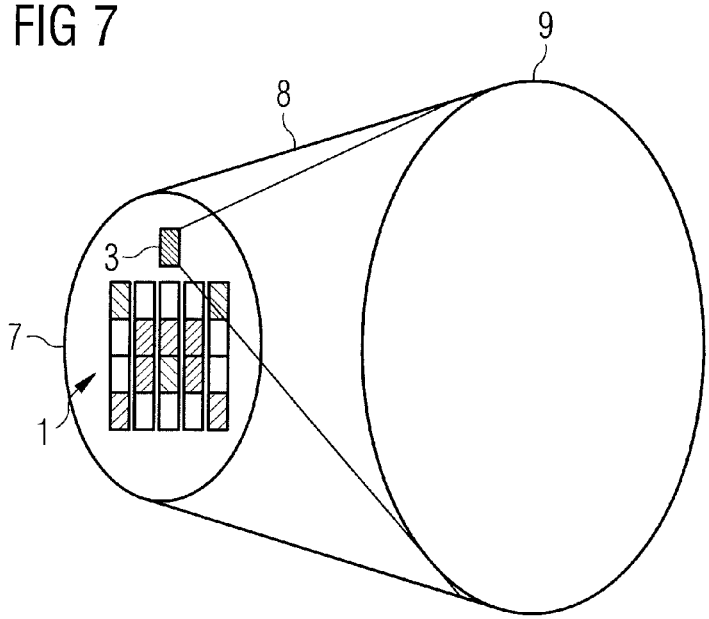
FIG. 7 shows an example of an arrangement of a multitude of LEDs and a sensor.

FIG. 7 shows an example of an arrangement of the multitude of LEDs 1 and the sensor 3. The multitude of LEDs 1 and the sensor 3 are arranged on a base plate 7 surrounded by a reflector 8 formed as a sleeve of pyramid-shaped housing and having a diffuser plate 9 on top. The light 2 emitted from the multitude of LEDs 1 hits the diffuser plate 9. Most light is transmitted, but some reflects back to the sensor 3 generating the sensor signals 31 applied to the controller 4 which then alters the control signals 41 so that a given, e.g., constant, color of the emitted light 2 is maintained. The portion of the light that is reflected is known, which enable to determine the light output that passes through the diffuser plate 9.

Figure 8:
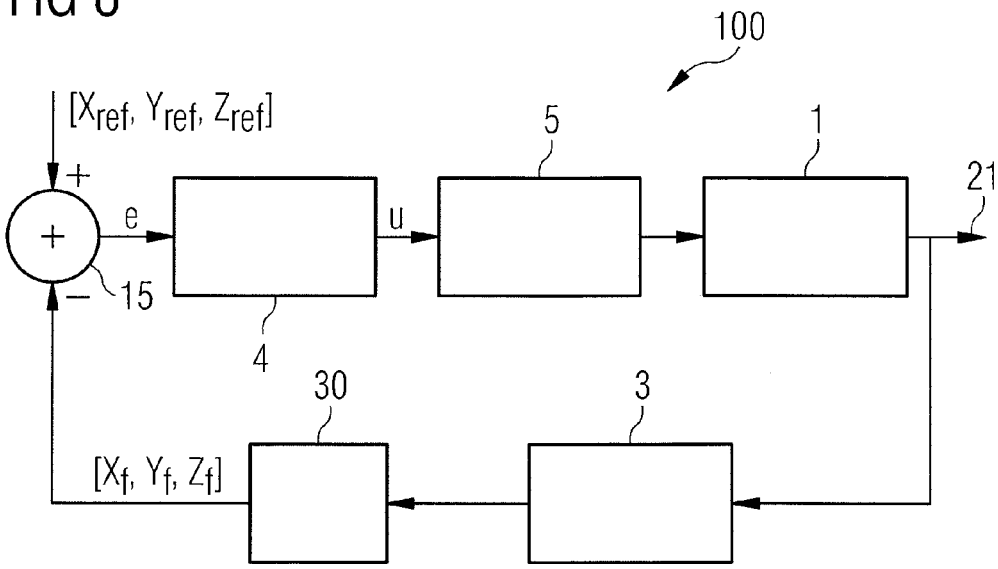
FIG. 8 shows a block diagram of an example of a first feedback loop.

FIG. 8 shows a block diagram of an example of a first feedback loop 100 that controls the first, second and third LEDs 11, 12, 13 of the tricolor LED system. This example illustrates the regulating concept. It should be mentioned that each block 15, 4, 5, 1, 3, 20 need not necessarily be one electric or electronic component in a regulating system circuit. In other words, one component of the regulating system circuit may provide the functions of more than one of the blocks. Alternatively, two or more components may build one block.

The first feedback loop 100 comprises a controller 4 and LED drivers 5 that drive the tricolor LED system 1. The first feedback loop 100 also comprises a sensor 3, a gain element 30 and a summing block 15 which may be implemented, e.g., in a microcontroller serving as controller 4. The gain element 30 may be integrated in the sensor component or be implemented in the microcontroller.

The target spectrum is represented in the CIE XYZ color space by reference tristimulus values [Xref, Yref, Zref] that may be stored in the controller 4. The reference values [Xref, Yref, Zref] may represent a target color that should be emitted by the multitude of LEDs 1. One value of the reference tristimulus values [Xref, Yref, Zref] is stored for each color, where color and brightness information are both included in the reference tristimulus values [Xref, Yref, Zref].

Feedback tristimulus values [Xf, Yf, Zf] representing the characteristics of the emitted light 21 are subtracted from the reference tristimulus values [Xref, Yref, Zref]. The results e are applied to the controller 4 that outputs control signals u for the LED drivers 5 providing LED currents for the first, second and third LEDs 11, 12, 13 of the tricolor LED system.

The sensor 3 measures characteristics RGB, which is a triple set of values, of the emitted, e.g., white light 21. The gain element 30 coupled downstream of the sensor 3 transfers the measured characteristics RGB into the feedback tristimulus values [Xf, Yf, Zf] which are provided to the summing block 15.

The sensor signals are the counts of the sensor 3 described in connection with FIGS. 2, 3 and 4. The gain element 30 enables a matrix multiplication transferring the triple RGB that are the counts of the three LEDs 301*a*, 301*b*, 301*c* into meaningful feedback tristimulus values [Xf, Yf, Zf].

Only one control loop 100 is shown in FIG. 8, but the data is represented as triple [Xf, Yf, Zf] or [Xref, Yref, Zref]. This means there are effectively three substantially identical loops 100 each with the same components except for the LEDs 11, 12, 13 they control, their references tristimulus values [Xref, Yref, Zref], and their photo sensor inputs. A single microchip may provide controller functions for the three loops 100.

The following figures illustrate the function of the gain element 30.

Figure 9:
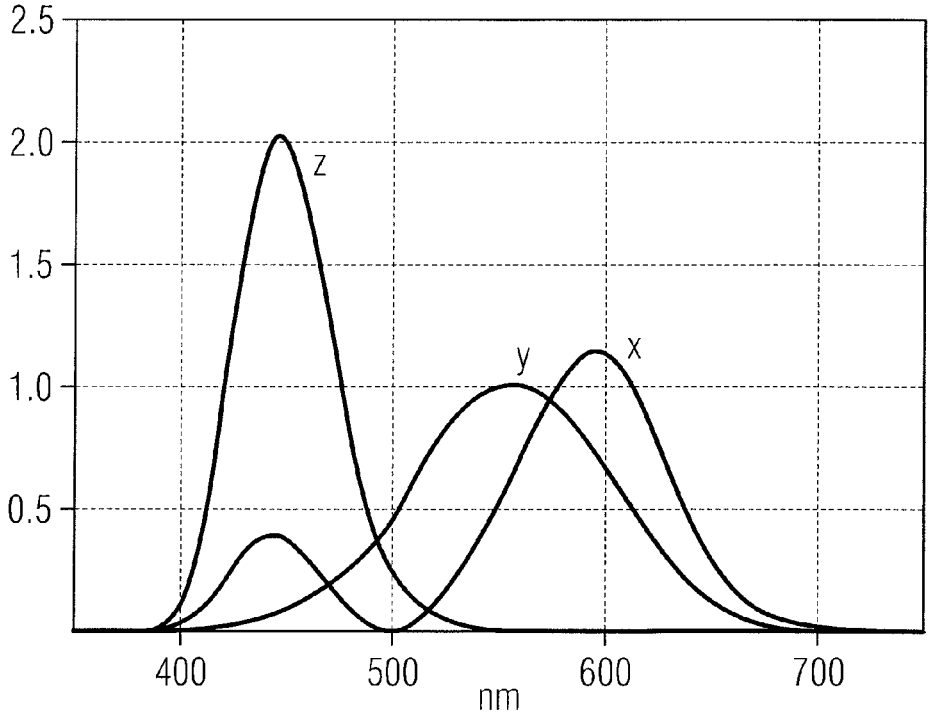
FIG. 9 shows the CIE standard observer functions x, y, z over the wavelength.
Figure 10:
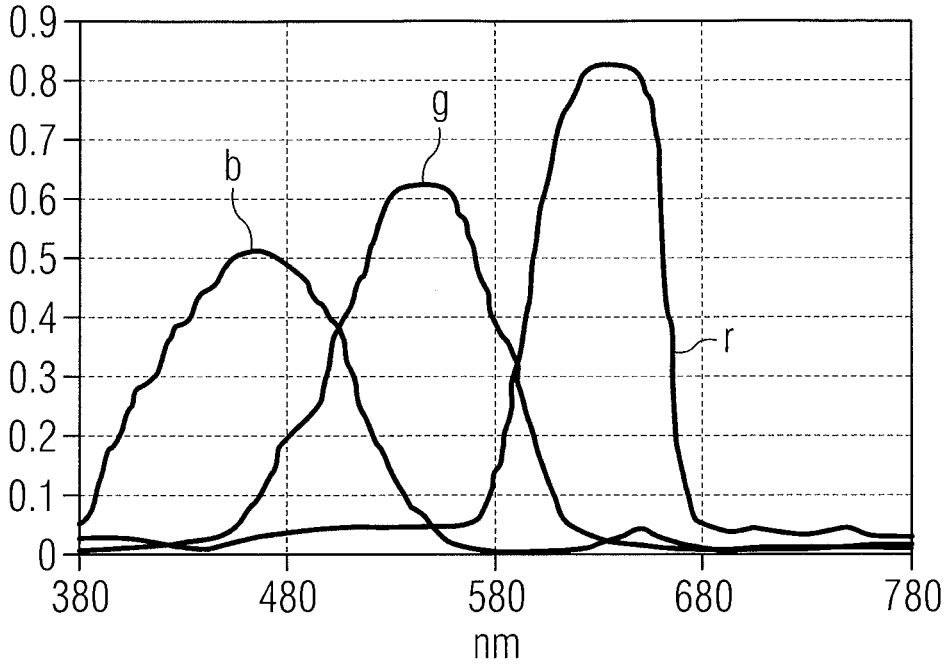
FIG. 10 shows spectral curves of an ROB tricolor sensor.

FIG. 9 shows the CIE standard observer functions x, y, z over the wavelength. FIG. 10 shows the spectral curves of an example of a tricolor ROB sensor 3 for its red (r), green (g) and blue (b) photodiodes 301*a*, 301*b*, 301*c*. The CIE standard observer functions x, y, z are needed to measure and describe the tristimulus light characteristics [X, Y, Z] in the CIE XYZ color space. Unfortunately the spectral curves r, g, b of the sensor 3 differ significantly from the CIE standard observer functions x, y, z which are the basis of the representation of the light by feedback tristimulus values [Xf, Yf, Zf], and reference tristimulus values [Xref, Yref, Zref]. The data triple from the sensor 3 is in a ROB color space and must be converted to the feedback tristimulus values [Xf, Yf, Zf] so that the error e between the reference tristimulus values [Xref, Yref, Zref] and the feedback tristimulus values [Xf, Yf, Zf] can be calculated.

Figure 11:
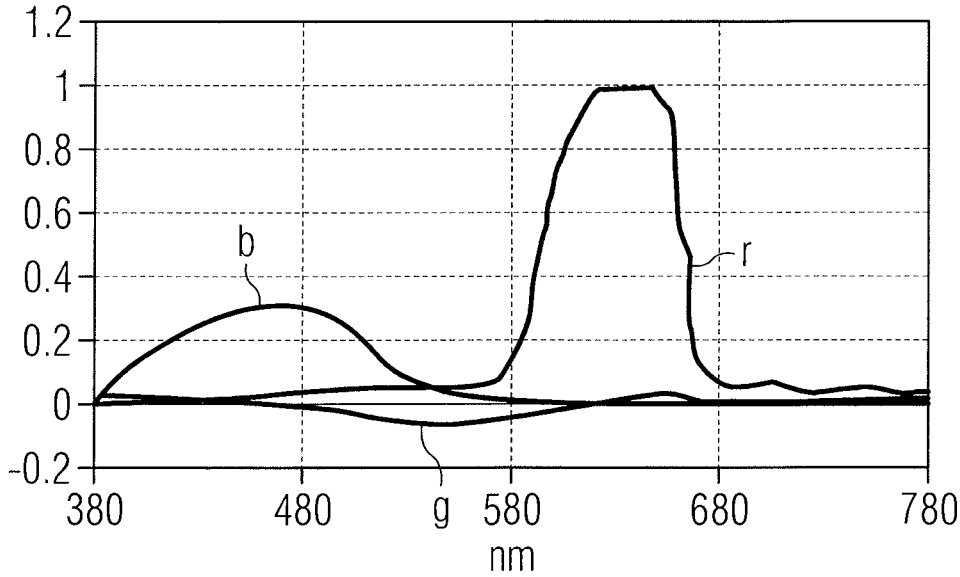
FIG. 11 shows a linear combination of spectral curves approximating the CIE x curve.

The CIE standard observer functions x, y, z may be approximated and represented by linear combinations of the sensor spectral curves r, g, b. FIG. 11 shows the linear combination approximating the CIE x curve: 1.2r−0.1g+0.6b.

Since CIE standard observer functions x, y, z may be described as linear combinations of the sensor curves r, g, b, the linear combinations may be represented in 3×3 matrix form by a matrix Gs. The sensor signal triple RGB based on integrations of the spectral curves r, g, b can be transferred into the feedback tristimulus values [Xf, Yf, Zf] based on integrations of the CIE curves x, y, z by the matrix multiplication with Gs.

The linear combination represented in matrix form is shown below. The coefficients for the tristimulus value X are shown:

$$\begin{bmatrix} X \\ Y \\ Z \end{bmatrix} = \begin{bmatrix} 1.2 & -0.1 & 0.6 \\ \dots & \dots & \dots \\ \dots & \dots & \dots \end{bmatrix} \begin{bmatrix} R \\ G \\ B \end{bmatrix}$$

In practice, the coefficients contain more information which may include scaling count integers to floating point and fixture face reflectance. The matrix is derived from an optical calibration.

The following examples of coefficients were generated in a lab:

$$\begin{bmatrix} X \\ Y \\ Z \end{bmatrix} = \begin{bmatrix} 4.866734894E-04 & -5.439544975E-05 & 3.814397843E-04 \\ 1.776755210E-04 & 6.116070492E-04 & -9.238146524E-06 \\ 1.875459194E-05 & -7.159748491E-04 & 2.166427738E-03 \end{bmatrix} \begin{bmatrix} R \\ G \\ B \end{bmatrix}$$

The input to the controller 4 which is a proportional-integral (PI) controller is the error signal being the difference between the reference tristimulus values and the feedback tristimulus values:

$$e=[X\text{ref}, Y\text{ref}, Z\text{ref}]-[Xf, Yf, Zf]$$

The controller 4 determines how quickly or slowly the first, second and third LEDs 11, 12, 13 are adjusted. Further, it tends to prevent uncontrolled oscillations. The feedback loops are discrete so that the compensator 4 is governed by difference equations.

A PI Controller is a feedback controller, wherein the output value u(n) depends on the previous output value u(n−1) and the weighted error value e(n) minus the weighted previous error value e(n−1), e and u being also shown in FIG. 8:

$$A*e(n)-B*e(n-1)+u(n-1)=u(n).$$

Specific to this application where u is a PWM control signal and e is the error signal, this means:

$$\text{PWM}=A*\text{error}-B*\text{last_error}+\text{last_PWM}.$$

This equation is executed each time the program iterates. The PI controller 4 stores the error and PWM control values so that they can be used as last_error and last_PWM values for the next step. The controller 4 receives the error signal from the summing block 15 and manipulates the output of the loop to achieve zero error while maintaining the loop stability.

If the error and the last_error values are equal to zero, the PWM and last_PWM values are equal. A and B are coefficients of the PI controller 4 chosen so that the system is stable. Use of the last_error and last_PWM values of the previous step causes a dampening effect which is a kind of limiting of the rate of change and an integrating effect, thereby helping to reduce the output drift.

A given target spectrum may be convolved with the CIE standard observer functions x, y, z to yield the reference tristimulus values [Xref, Yref, Zref]. Since the CIE standard observer functions x, y, z and the spectral curves r, g, b of the sensor 3 differ, there is crosstalk between the LED feedback loops.

Figure 12:
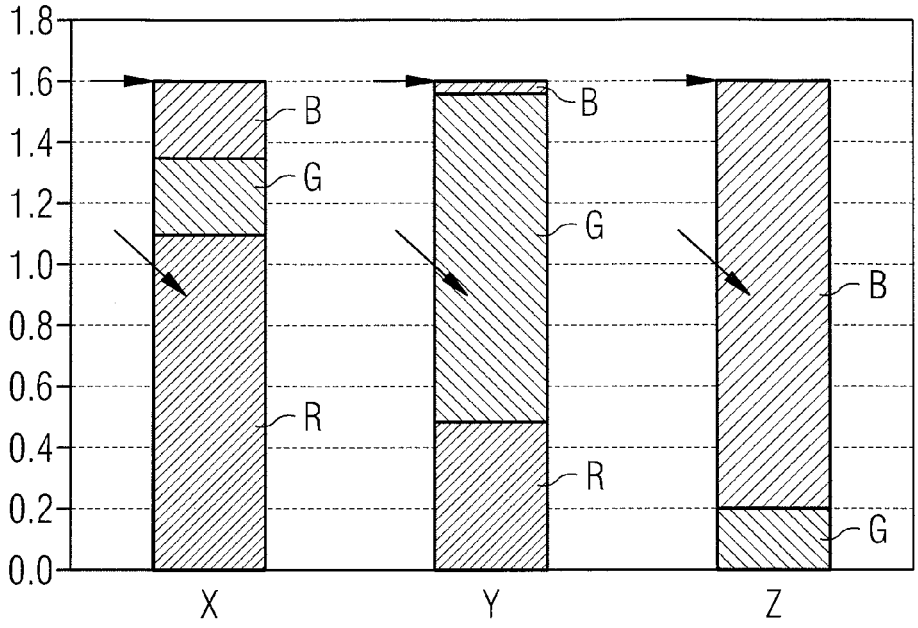
FIGS. 12 and 13 show tristimulus magnitudes.

FIG. 12 shows the tristimulus magnitudes of X, Y, Z at 3500 K and the parts R, G, B of each value caused by the red, green and blue components 11, 12, 13. R is caused by the red or first LEDs 11. G is caused by the green or second LEDs 12. B is caused by the blue or third LEDs 13. X is dominated by the red light. However, there are also green and a lesser blue light influences, and the X reference loop 100 controls the control signals 51 for the red or first LEDs 11 as indicated by the arrow. The red LEDs 11 are used to regulate the X value. Nevertheless, the green and blue LEDs 12, 13 also influence the X value, but do not control it. In other words, the light emitted by green and blue LEDs 12, 13 crosstalks with X, causes noise and disturbs it. Similar effects arise in the loops 100 controlling the second and third LEDs 12, 13 that emit green and blue light. Y and Z also have crosstalk components. However, the Y reference loop controls the drive signals for the green or second LEDs 12. The Z reference loop controls the drive signals for the blue or third LEDs 13. Each control loop 100 needs to deal with the noise from the other LEDs.

The black, horizontal arrows in FIG. 12 show reference values for the tricolor LED system 1. The three loops 100 control the tricolor LED system 1 so that the feedback tristimulus values correspond with the reference tristimulus values. The interaction of the three loops 199 is suitable to control the crosstalk effects and adjusts the outputs of the first, second and third LEDs 11, 12, 13 so that their emitted light characteristics correspond with the reference light characteristics.

If the regulating system also includes fourth LEDs 14 that may emit, e.g., white light, the tristimulus values [X, Y, Z] of the mixed light 2 also have components caused by the light emitted by the fourth LEDs 14.

Figure 13:
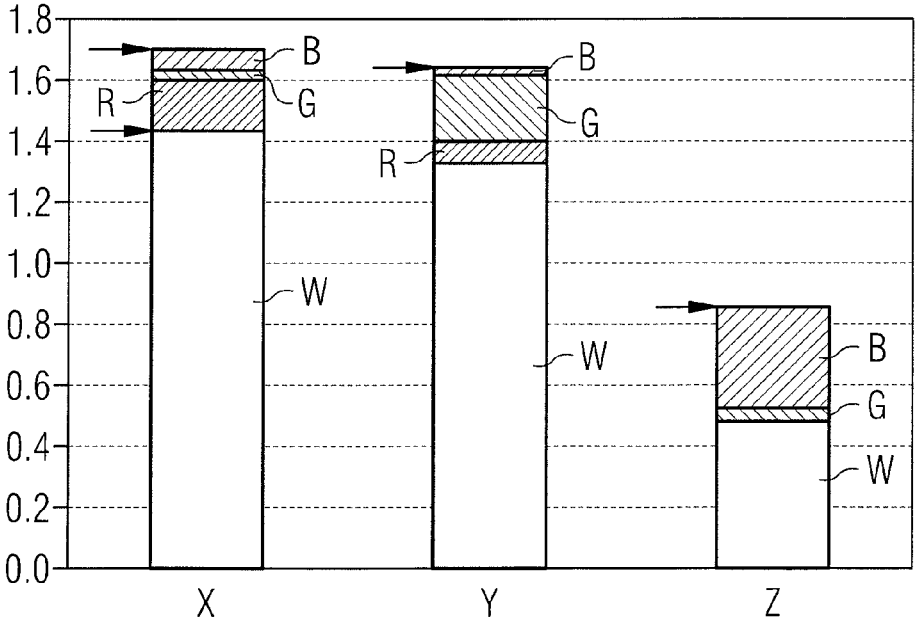

FIG. 13 shows the magnitude of the tristimulus values [X, Y, Z] at 3500 K and the quantities of light emitted by the first, second, third and fourth LEDs 11, 12, 13, 14. W indicates the component of the light emitted by the fourth LEDs 14.

In a tricolor LED system, each of the tristimulus values X, Y, Z are dominated by one type of the first, second and third LEDs 11, 12, 13. In other words, X is nearly synonymous with red. Y is nearly synonymous green and Z is nearly synonymous with blue. If a further light source that may emit white light is thrown into that analogy, it can become confusing. X has components from red, blue, and white, with a small amount from green light. The loops 100 now crosstalk and disturb each other even more.

When the feedback is running, several attributes of the graph indicated by the arrows are used as references. The feedback seeks to make the light output match the reference points. Three reference points are the magnitude values of the X, Y, Z tristimulus values. The fourth reference point is the magnitude of quantity of one tristimulus value caused by the fourth LEDs 14. In FIG. 13, the magnitude of the X tristimulus value caused by the fourth LEDs 14 is chosen as reference value.

The spectrum characterized by the reference values should be maintained. Control loops 100, 200 hold the output values stationary based on the error signals. The overall levels of the tristimulus values X, Y, Z needs to be maintained since they govern the resultant color. The output of the white, fourth LEDs 14 is to be maintained due to its large CRI and flux contributions.

Figure 14:
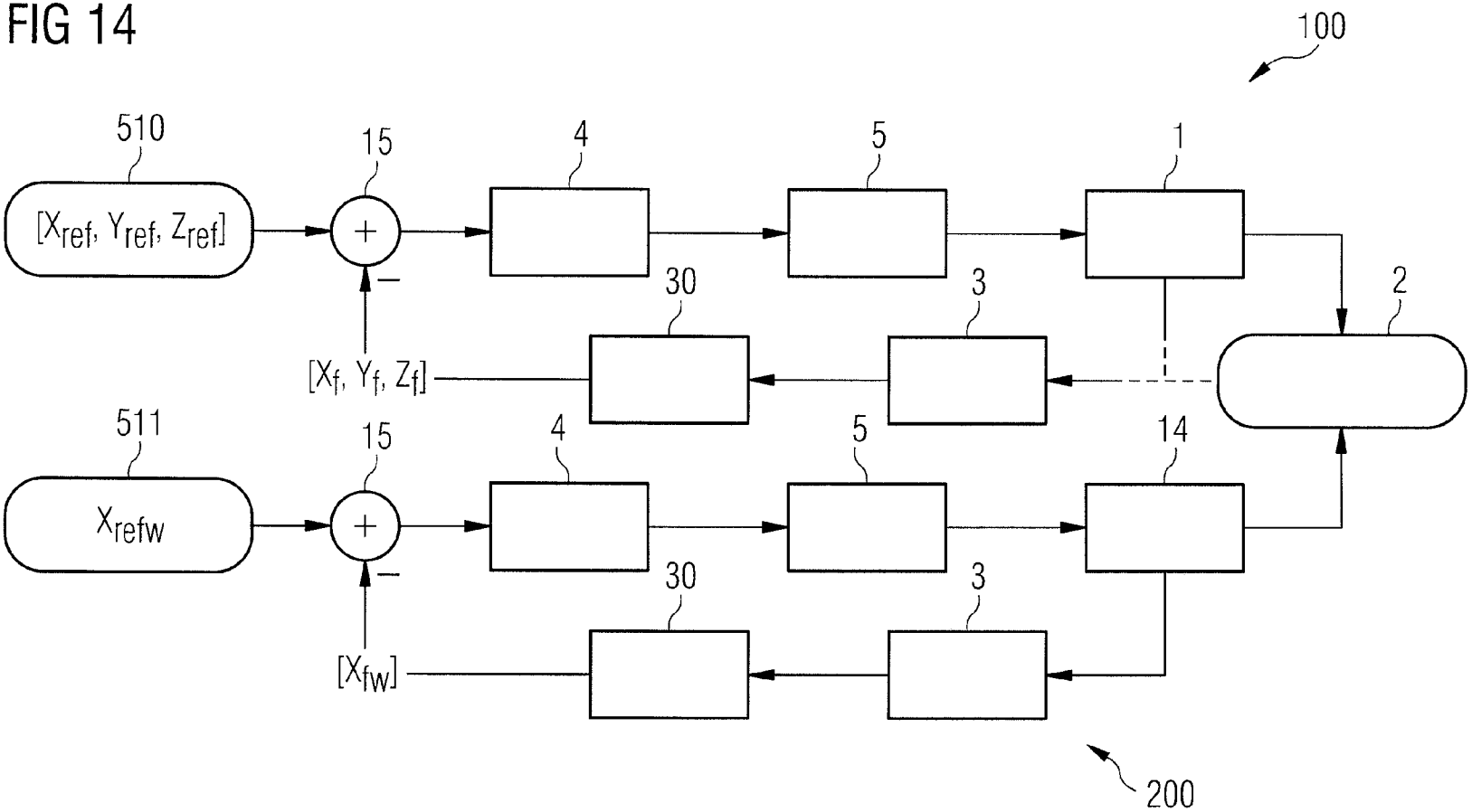
FIG. 14 shows a block diagram of an example having a second loop.

FIG. 14 shows a block diagram of an example which includes a second loop 200 to control the fourth LEDs 14. The regulating system also comprises three first loops 100 to regulate the first, second and third LEDs 11, 12, 13. (Only one is shown in FIG. 14.)

Overall, the regulating system comprises four loops 100, 200 that control the output of the first, second, third and fourth LEDs 11, 12, 13, 14, altogether emitting the mixed light 2. The first loops 100 maintain the total tristimulus values of the system. The second loop 200 maintain the broadband spectrum fourth LEDs 14 at a lower output level.

The reference values for the first loop 100 are the tristimulus values of the target spectrum of the mixed light 2, if the feedback tristimulus values represent the characteristics of the mixed light emitted by the multitude of LEDs 1. Alternatively, the reference values for the first loop 100 may be the target tristimulus values for the spectrum of the tricolor LED system 1 if the feedback tristimulus values represent characteristics only of the light emitted by the first, second and third LEDs 11, 12, 13.

The second loop 200 comprises a controller 4 that may be a PI controller, an LED driver 5 for the fourth, broadband spectrum LEDs 14, a sensor 3 and a gain element 30. The reference value for the second loop 200 may be one of the tristimulus values for the target spectrum of the light emitted by fourth LED 14. An exemplary reference value may be the X value of tristimulus values of the target spectrum Xrefw.

Figure 15:
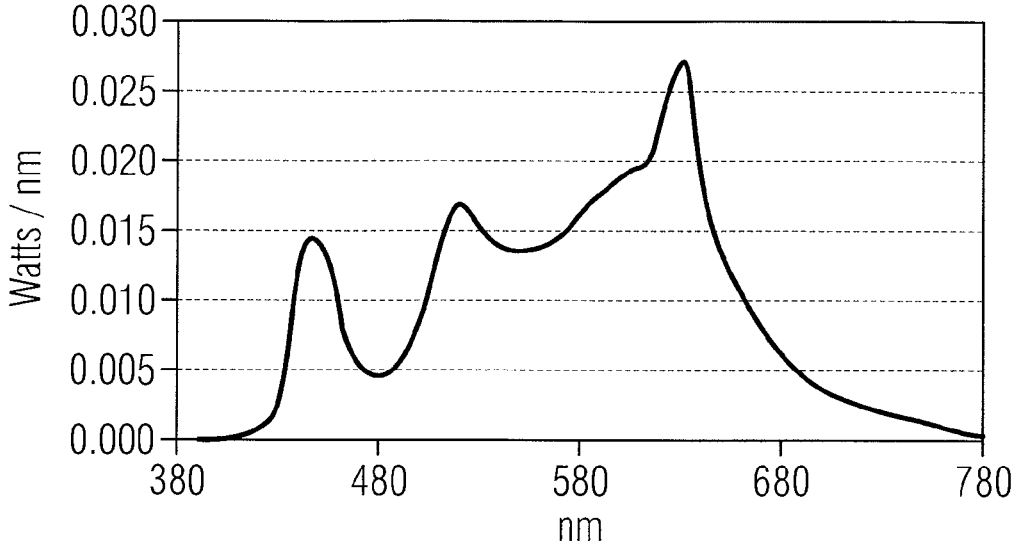
FIGS. 15 and 16 show a target spectrum and its spectral components.
Figure 16:
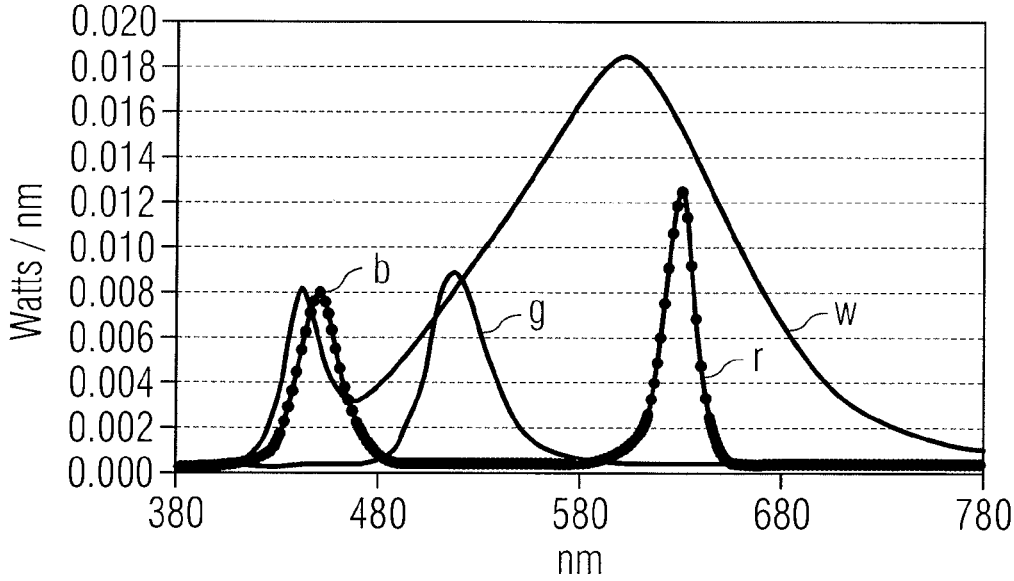

FIG. 15 shows an example of a target spectrum for 3500 K, 95 CRI. This spectrum may be deconstructed into individual spectra based on the used first, second, third and fourth LEDs, that may be saturated and broadband LEDs. FIG. 16 show the parts of the spectra r, g, b, w contributed from each type of these LEDs 11, 12, 13, 14.

Figure 17:
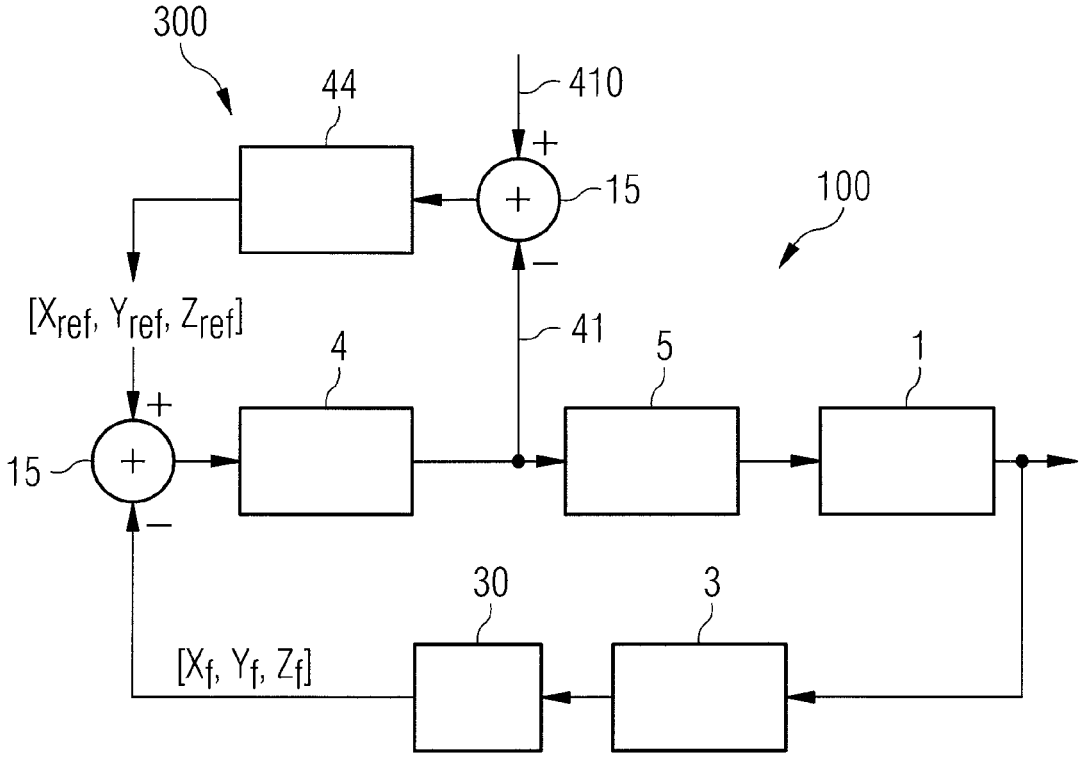
FIGS. 17 and 18 show block diagrams of further examples having additional loops.

FIG. 17 shows a block diagram of a further example of a first loop 100 based on the example shown in FIG. 8. This example comprises an additional loop 300 having an additional controller 44 that may be a PI controller. The input of the additional controller 44 is the difference between reference control values 420 and the output values of the controller 4, namely the control signals 41. The additional controller 44 amends the reference values [Xref, Yref, Zref] for the loops 100.

The additional control loop 300 is used to make the brightness of the LEDs as high as possible. This regulating system can keep its color constant and increase its brightness to the maximum point before the control signals 41 become saturated and the color is lost. This effect is caused by the additional feedback loop 300 serving for scaling the reference values [Xref, Yref, Zref].

Figure 18:
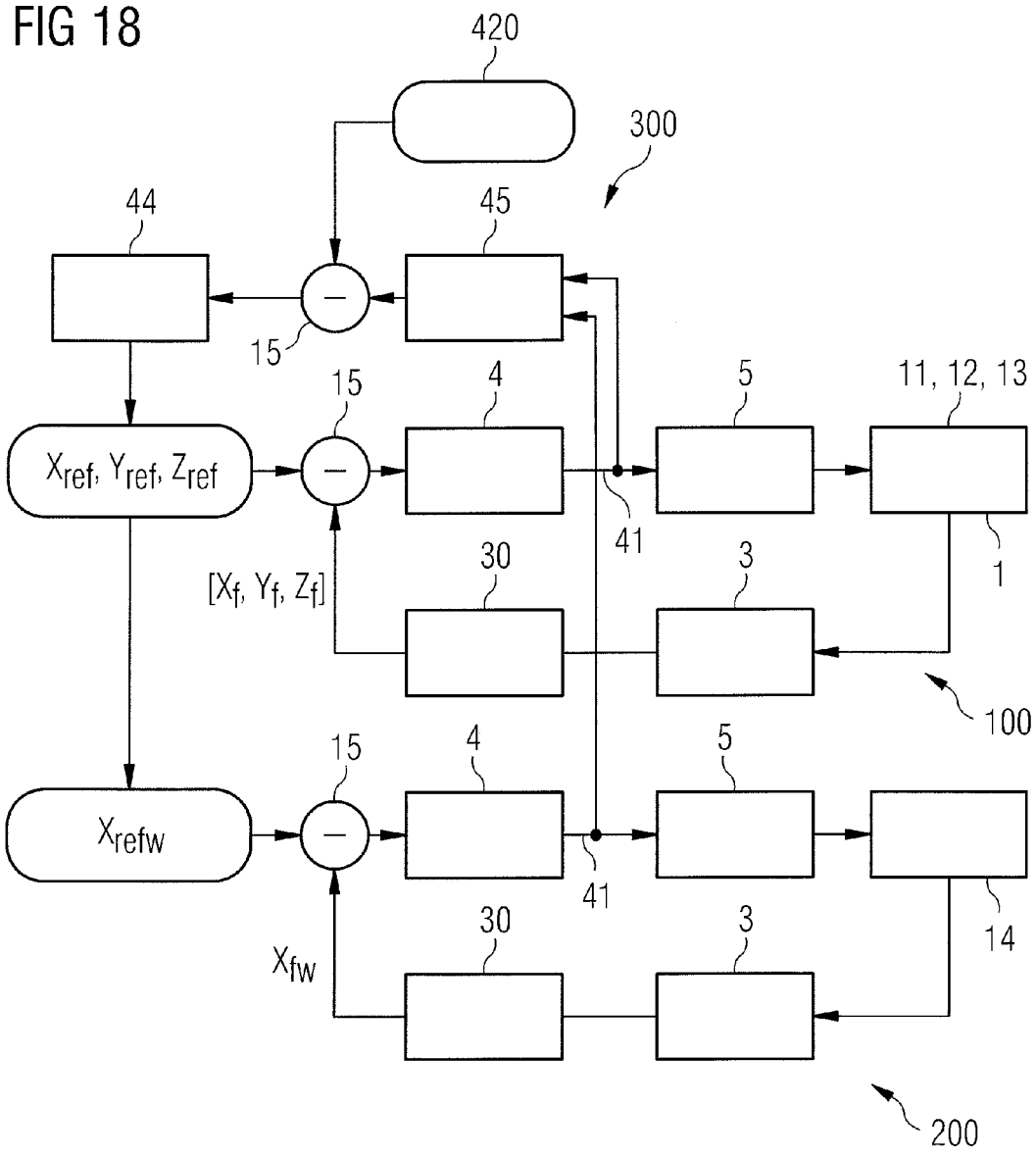

FIG. 18 shows a block diagram of a regulating system comprising first loops 100 (only one is shown) and a second loop 200 and an additional loop 300. In this instance, the feedback tristimulus values [Xf, Yf, Zf] in the first loop 100 represent the output from the multitude of LEDs 1. The reference tristimulus values [Xref, Yref, Zref] represent the target spectrum of the mixed light 2 emitted by the multitude of LEDs 1. The feedback tristimulus values Xfw in the second loop 200 represent the output from the fourth LEDs 4. The reference value Xrefw represents the X tristimulus value of the target spectrum of the light emitted by the fourth LEDs 14.

The system further comprises a comparator 45 to determine the maximum PWM control value of the PWM control values 41 generated by the controllers 4 in the first and second loops 100, 200. The negative result is applied to a summing block 15 which generates the difference between a reference PWM control value 420 and the maximum PWM control value. The result is applied to an additional controller 44, that may be a PI controller, which amends the reference tristimulus values [Xref, Yref, Zref], Xrefw of the first and second loops 100, 200.

The first, second, third and fourth LEDs 11, 12, 13, 14 in the system heat up during operation and age which causes a decrease in their light output. This causes the feedback loops to adjust the PWM control signals 41 so that their values increase. Over the time these PWMs control signals 41 could approach 100%. If they go beyond 100% then they clip and color regulation is lost. For these reasons, the maximum brightness during calibration is generally selected to be at 80%, for example, of the maximum possible luminance with all LEDs driven at 100% duty cycle. This gives the PWMs control signals 41 headroom so that clipping will not occur. However, it also means that, most of the time, the LEDs 11, 12, 13, 14 are not used at full capacity.

The additional loop 300 scales the reference tristimulus values [Xref, Yref, Zref] and Xrefw in real time so that the PWM control signals 41 in one of the loops are at 100% so that the system operates at its highest possible brightness. The automatic scaling is accomplished by taking samples of all the PWM control signals 41 from the four loops 100, 200 and determining what is the highest at a particular time. This highest sample is then compared to the 100% PWM reference control signal value 420 to determine the error value. This error value is then fed to the additional PI compensator 44 which is similar to the ones used for the first and second loops 100, 200 (with a much reduced gain so that oscillations do not occur). The output of this additional compensator 44 is a scaling factor multiplied with the reference tristimulus values [Xref, Yref, Zref] and Xrefw of the first and second loops 100, 200.

Figure 19:
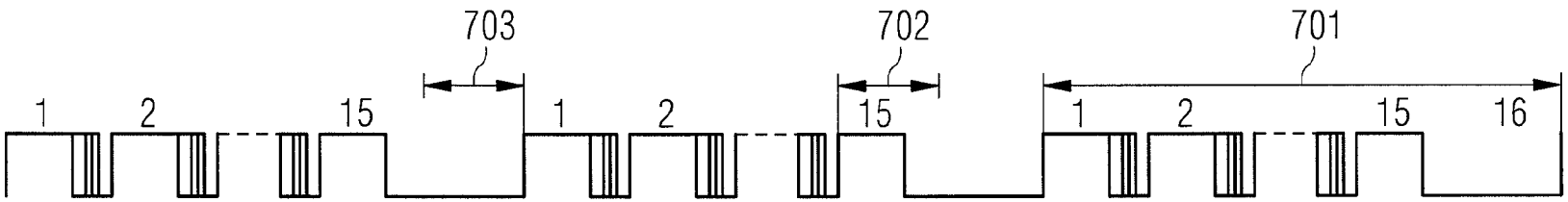
FIG. 19 shows a measurement pattern.

FIG. 19 shows a measurement pattern that can be used if only one RGB sensor 3 is provided in the regulating system. Since only three sensor signals may be transferred by the matrix multiplication at a time and there are four LED types 11, 12, 13, 14 in the system, a time multiplex pattern is used to generate feedback values of all four loops 100, 200.

The measurement pattern includes a sequence of sixteen cycles, where at least during a part of the first to fourteenth cycle the first, second, third and fourth LEDs 11, 12, 13, 14 emit mixed light 2. Only the fourth LEDs 14 emit light during the fifteenth cycle. None of the LEDs emit light during the sixteenth cycle.

The characteristics of the mixed light 2 are detected during a first time interval 701 comprising all sixteen cycles. The characteristics of the white light or the light emitted by the fourth LEDs 14 are detected during the fifteenth cycle where only light of the fourth LEDs is emitted. The ambient light is measured during the sixteenth cycle where no LED emits light. The white and ambient measurements are amplified in the sensor 3 by a factor of 16. The white measurement is subtracted from the measurement of the mixed light 2, which yields the ROB signals for the matrix multiplication. The sensor signals of the white measurement are fed to its own matrix that yield the tristimulus values [X, Y, Z] of the white light.

However, since the sensor 3 performs one integration at a time, a measurement cycle includes three sequences of 16 cycles, one sequence for measuring the ambient light, one for measuring the white light and one for measuring the mixed light 2. These sequences may be repeated for averaging.

This pattern is active whether the measurements are being performed or not. The pattern is 16 PWM control signal cycles long which works out to 0.5 ms*16=8 ms, ⅛ ms=125 Hz making it very hard to see the pattern. Choosing shorter cycles is not encouraged due to extra heat in the LED drivers 5, loss of sensor resolution, and short integration times that can create an analog saturation effect in the sensor 3 which ruins the measurements. The highest possible frequency is 4 kHz with a crystal used with the microchip.

Figure 20:
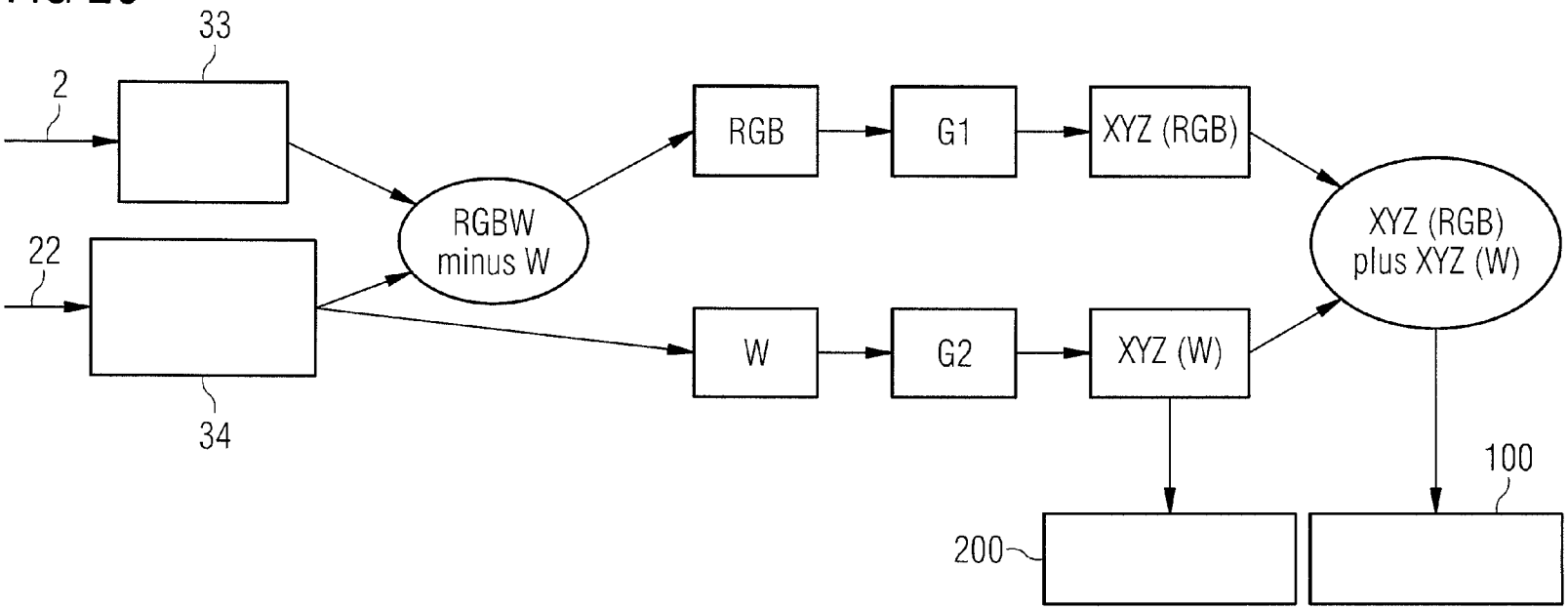
FIG. 20 shows a block diagram illustrating measurements during a system cycle.

FIG. 20 shows a block diagram illustrating the measurements during a system cycle. Block 33 illustrates measuring the characteristics RGBW of the mixed light 2. Block 34 illustrates measuring the characteristics of the light 22 emitted by the fourth LEDs 14. As mentioned above, the same sensor 3 measures the mixed and the white light. The differences between the characteristics of the mixed light RGBW and the white light W are the characteristics RGB of the light emitted by the tricolor LED system which are transferred by a matrix multiplication with the matrix G1 to tristimulus values [X, Y, Z]. The characteristics W of the white light 22 are transferred by a matrix multiplication with the matrix G2 to an [X, Y, Z] triple, the latter being the input of the second loop 200 to adjust the light 22 emitted by the fourth LEDs 14. The sum of the tristimulus values are the input of the first loops 100 to adjust the light emitted by the first, second and third LEDs 11, 12, 13.

Overall, the feedback process works in discrete steps, namely measuring calculation or running display and updating the control signals. In one example, each step or cycle takes 134 ms if an 8-bit microprocessor is used. If a 16-bit microprocessor is used the cycle time is less.

Each system cycle includes a 72 ms measurement slot and a 62 ms algorithm calculation slot. Then the control signal is updated and the next cycle starts. The calculating algorithm runs in the foreground. The sensor readings and averaging of the measured values run in the background. During each system cycle, the following steps are performed: In the measurement slot calculations are performed and an interrupt is generated when the sensor 3 is ready to provide the data. In the algorithm calculation slot of the algorithm the calculation based on the newly received data are performed and an interrupt is generated to send text data to display. At the end of the system cycle a main timer overflow interrupt is generated which causes updating the PWM control signal data.

Figure 21:
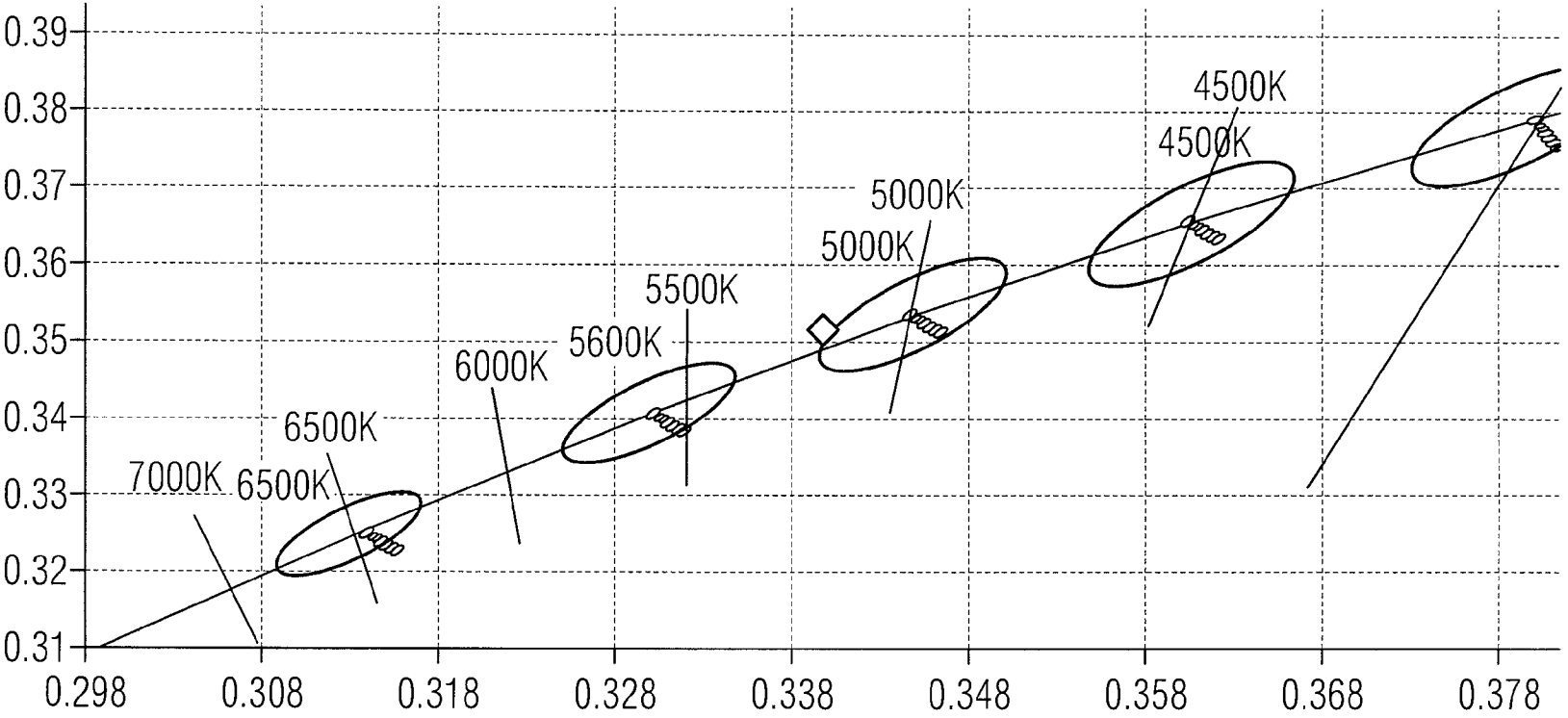
FIG. 21 shows test results of the regulating system.

FIG. 21 shows test results of the regulating system.

The test started at room temperature of 21 degree Celsius, and ran for about one hour at one given correlated color temperature (CCT). The board may have reached a temperature of about 40 degree Celsius during the test. Parts of the board, e.g., junctions, may have reached higher temperatures, e.g., about 48 degrees Celsius. After cooling the arrangement back to room temperature, the test ran at another CCT.

FIG. 21 shows the measurement points during the tests with increasing junction temperature. The clusters of points clearly indicate that the arrangement was suitable for adjusting the LEDs 11, 12, 13, 14 so that the emitted light only slightly change with increasing temperature of the arrangement.

The light emitted by the system at all color temperatures merely vary within 6% of 700 lumens. It did not drop with increasing temperature. The CRI was easy to maintain. The changes that were observed were small enough not to be noticeable. Considering the CRI, it was highest for the warmest and coolest colors. The middle colors were closer to 90. The deep blue gave a larger CRI boost than a regular blue.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A regulating system comprising:

a tricolor LED system comprising:

at least one first LED that emits light having a first color, at least one second LED that emits light having a second color, and at least one third LED that emits light having a third color, at least one fourth LED that emits light having a fourth color, a sensor that detects light emitted by the LEDs and generating sensor signals representing characteristics of the light, wherein the sensor is an RGB sensor that measures characteristics of mixed light emitted by the tricolor LED system and the fourth LED during a first time interval and generates a triple set of values representing the characteristics of the mixed light, and the sensor measures characteristics of light emitted by the fourth LED during a second time interval, where the tricolor LED system does not emit light, and generates a triple set of values representing the characteristics of the light emitted by the fourth LED, a controller that outputs control signals depending on the sensor signals and reference values, and LED drivers that drive the first, second, third and fourth LEDs depending on the control signals.

2. The regulating system according to claim 1, wherein the sensor is an RGB sensor that generates a triple set of values representing the characteristics of the light.

3. The regulating system according to claim 1, wherein the control signals are generated depending on reference 1) tristimulus values and 2) feedback tristimulus values representing characteristics of the light detected by the sensor.

4. The regulating system according to claim 3, wherein the reference tristimulus values comprise a triple set of tristimulus values including an X value, a Y value and a Z value and the feedback tristimulus values comprise a triple set of tristimulus values including an X' value, a Y' value and a Z' value, the triple set representing characteristics of the mixed light emitted by the tricolor LED system and the fourth LED or of the light emitted by the tricolor LED system, the control signal that drives the first LED being generated depending on an error between an X value of the reference tristimulus values and an X' value of the feedback tristimulus values, the control signal that drives the second LED being generated depending on an error between a Y value of the reference tristimulus values and a Y' value of the feedback tristimulus values, and the control signal that drives the third LED being generated depending on an error between a Z value of the reference tristimulus values and a Z' value of the feedback tristimulus values.

5. The regulating system according to claim 4, wherein the reference tristimulus values comprise a further tristimulus value being one of an X value, a Y value and a Z value and the feedback tristimulus values comprise a further tristimulus value being one of an X' value, a Y' value and a Z' value, the further tristimulus value representing the characteristic of the light emitted by the fourth LED, the control signal that drives the fourth LEDs is generated depending on an error between at least the further tristimulus value of the reference tristimulus values and the further tristimulus value of the feedback tristimulus values.

6. The regulating system according to claim 3, wherein the reference tristimulus values comprise a further tristimulus value being one of an X value, a Y value and a Z value and the feedback tristimulus values comprise a further tristimulus value being one of an X' value, a Y' value and a Z' value, the further tristimulus value representing the characteristic of the light emitted by the fourth LED, the control signal that drives the fourth LEDs is generated depending on an error between at least the further tristimulus value of the reference tristimulus values and the further tristimulus value of the feedback tristimulus values.

7. The regulating system according to claim 1, wherein the control signals are generated depending on reference 1) tristimulus values and 2) feedback tristimulus values representing characteristics of the light detected by the sensor.

8. The regulating system according to claim 1, wherein the controller is a proportional-integral (PI) controller.

9. The regulating system according to claim 1, further comprising an additional controller that adjusts the reference values depending on the control signals and a reference control value.

10. The regulating system according to claim 9, further comprising a comparator that outputs a maximum value of the control signals and a summing block outputting an error signal between the reference control value and the maximum value applied to the additional controller.

11. The regulating system according to claim 10, wherein the additional controller is a proportional-integral (PI) controller.

12. The regulating system according to claim 9, wherein the additional controller is a proportional-integral (PI) controller.

13. The regulating system according to claim 1, wherein the controller generates pulse width modulation (PWM) signals.

14. The regulating system according to claim 1, wherein the reference values represent characteristics of a predetermined power spectral density.

15. The regulating system according to claim 1, wherein the tricolor LED system comprises a red light emitting LED, a green light emitting LED and a blue light emitting LED.

16. The regulating system according to claim 1, wherein the fourth LED is a white light emitting broadband spectrum LED.

* * * * *